United States Patent [19]

Kumakawa et al.

[11] 4,356,234

[45] Oct. 26, 1982

[54] THERMOPLASTIC SYNTHETIC FILAMENTS AND PROCESS FOR PRODUCING THE SAME

[75] Inventors: Shiro Kumakawa, Ibaraki; Toshimasa Kuroda, Takatsuki, both of Japan

[73] Assignee: Teijin Limited, Osaka, Japan

[21] Appl. No.: 240,834

[22] Filed: Mar. 5, 1981

[30] Foreign Application Priority Data

| | | | |
|---|---|---|---|
| Mar. 12, 1980 | [JP] | Japan | 55-30259 |
| Mar. 19, 1980 | [JP] | Japan | 55-33947 |
| Mar. 19, 1980 | [JP] | Japan | 55-33948 |

[51] Int. Cl.[3] ..... D02G 3/00

[52] U.S. Cl. ..... 428/372; 57/247; 57/248; 428/400

[58] Field of Search ..... 428/399, 400, 398, 376, 428/372, 375; 264/41, 49, 45.8, 344; 57/247, 248

[56] References Cited

U.S. PATENT DOCUMENTS

| | | | |
|---|---|---|---|
| 3,221,090 | 11/1965 | Thompson | 264/344 |
| 3,350,488 | 10/1967 | Breen | 264/344 X |
| 4,254,182 | 3/1981 | Yamaguchi et al. | 428/400 X |

*Primary Examiner*—Lorraine T. Kendell

*Attorney, Agent, or Firm*—Burgess, Ryan and Wayne

[57] ABSTRACT

Thermoplastic synthetic filaments having a properly delustered appearance and an adequate frictional property, comprise 85 to 99% by weight of a thermoplastic matrix polymer and 1 to 15% by weight of a dispersed polymer which is incompatible with the matrix polymer and uniformly dispersed in the form of fine particles in the matrix polymer, and are characterized by numerous fine protuberances consisting of the dispersed polymer and formed in the number of at least 5 per 10 $\mu^2$ on the peripheral surface of each individual filament, the protuberances preferably being each in the form of a hemisphere, hemispheroid or hemiellipsoid extending along the longitudinal axis of each individual filament.

13 Claims, 4 Drawing Figures x 3000 x 3000 x 3000 x 3000 x 3000

THERMOPLASTIC SYNTHETIC FILAMENTS AND PROCESS FOR PRODUCING THE SAME

FIELD OF THE INVENTION

The present invention relates to thermoplastic synthetic filaments and a process for producing the same. More particularly, the present invention relates to thermoplastic synthetic filaments each having an uneven peripheral surface thereof and a process for producing the same.

BACKGROUND OF THE INVENTION

It is known that in order to produce thermoplastic synthetic filament having a desired gloss and frictional property, an inter inorganic substance, for example, titanium dioxide or china clay, in the form of fine solid particles is dispersed in a thermoplastic synthetic matrix polymer. That is, the inorganic particles are effective for modifying the optical and frictional properties of the filaments. The dispersed inorganic particles result in formation of numerous protuberances on the peripheral surface of the resultant individual filament. The number of the protuberances depends on the amount of the inorganic particles dispersed in the matrix polymer. These numerous protuberances create various problems on the filaments. For example, when a mixture of the thermoplastic matrix polymer with dispersed inorganic particles is subjected to a melt-spinning process, the dispersed inorganic particles cause the melt-spun filamentary streams of the melted mixture to be frequently broken. Also, when the resultant filaments are subjected to a weaving or knitting process, the protuberances on the peripheral surfaces of the filaments serve to accelerate the wear of the reeds in the weaving machine or the needles in the knitting machine.

It is also known that when a fabric consisting of thermoplastic synthetic fibers, for example, polyethylene terephthalate fibers, is subjected to a raising process, it is very difficult to obtain a uniformly raised surface of the fabric having a satisfactory appearance, because of the excessively large tensile strength and snap back phenomenon of the synthetic fibers. The term "snap back phenomenon" used herein refers to a phenomenon whereby the fibers or filaments in the fabric are stretched and, then, broken by the raising action applied to the fabric, the end portions of the stretched and broken fibers or filaments elastically shrunk and irregularly crimped. The irregularly crimped end portions of the fibers or filaments cause the appearance of the raised fabric to be poor.

Furthermore, it is known that the thermoplastic synthetic filaments, for example, polyethylene terephthalate filaments, exhibit a poor stretch-breaking property in a draft zone system spinning process, because the filaments have excessive tensile strength and ultimate elongation.

In order to improve the raising and stretch-breaking properties of the synthetic filaments, it was attempted to mix the thermoplastic filament-forming synthetic polymer with inert inorganic particles having a relatively large size, for example, calcium carbonate particles. The calcium carbonate is relatively ineffective for enhancing the stretch-breaking and raising properties of the resultant filaments. Therefore, the addition of calcium carbonate remains unsatisfactory.

Moreover, it is known that when a thermoplastic synthetic filament yarn is false-twisted at an elevated temperature at which the filaments in the yarn can be fuse-bonded to each other, the resultant false-twisted filament yarn exhibit a preferable hand like that of a strongly twisted filament yarn. However, the above-mentioned fuse-bond of the filaments causes the resultant filament yarn to exhibit an uneven dyeing property and a poor draping property. Also, it is difficult to control the fuse-bond type false-twisting process, and the quality of the resultant product varies widely.

Moreover, it is known that thermoplastic synthetic filaments, for example, polyethylene terephthalate filaments, are hydrophobic and, therefore, exhibit a poor water-absorbing property. In order to enhance the water-absorbing property, it was attempted to form numerous pores or concaves in the filaments. The pores or concaves were in the form of a simple line extending along the longitudinal axis of the filament. These pores or concaves cause the resultant filaments to exhibit an undesirably enhanced fibril-forming property and, therefore, to be easily divided into fine fibrils.

SUMMARY OF THE INVENTION

An object of the present invention is to provide thermoplastic synthetic filaments having preferably a delustered surface appearance and good frictional properties, and a process for producing the same.

Another object of the present invention is to provide thermoplastic synthetic filaments having satisfactory stretch-braking and raising properties, and a process for producing the same.

Still another object of the present invention is to provide thermoplastic synthetic filaments capable of being converted into a false-twisted filament yarn having a hand similar to that of conventional strongly twisted filament yarns and an excellent draping property, and a process for producing the same.

A further object of the present invention is to provide thermoplastic synthetic filaments capable of being converted into filaments having an excellent water-absorbing property, and a process for producing the same.

The above-mentioned objects can be attained by using the thermoplastic synthetic filaments of the present invention which comprise 85 to 99% by weight of a thermoplastic matrix polymer and 1 to 15% by weight of a dispersed polymer which is incompatible with the matrix polymer and dispersed in the form of fine particles in the matrix polymer, and which filaments are characterized by numerous fine protuberances consisting of the dispersed polymer and formed in the number of least 5 per 10 square microns on the peripheral surface of each individual filament.

The above-mentioned thermoplastic synthetic filaments can be produced by the process of the present invention which comprises the steps of:

- preparing a mixture of 85 to 99% by weight of a thermoplastic matrix polymer with 1 to 15% by weight of a dispersed polymer which is incompatible with the matrix polymer, and;
- melt-spinning the mixture to produce filaments in each of which the dispersed polymer is dispersed in the matrix polymer and numerous fine protuberances consisting of the dispersed polymer are formed with at least 5 per 10 square microns on the peripheral surface of each individual filament.

The thermoplastic synthetic filaments in which the matrix polymer is a polyester and which are in the form of a filament yarn and in a partially oriented state, can be converted into a drawn-false twisted filament yarn by draw-false twisting the filament yarn under the conditions satisfying the relationship (3):

$$\alpha \leqq 0.02T - 1.5D - 1.05 \quad (3)$$

wherein $\alpha$ represents a twisting coefficient in the range of from 0.4 to 0.9, T represents a false-twisting temperature in a range of from 150° to 200° C. and D represents a draw ratio satisfying the relationship (4):

$$0.80R_0 \leqq D \leqq R_0, \quad (4)$$

wherein $R_0$ represents a draw ratio which causes the resultant drawn filaments to exhibit an ultimate elongation of 30%, to produce a drawn-false-twisted filament yarn.

The thermoplastic synthetic filaments of the present invention, in which the matrix polymer is a polyester, can be converted into water-absorbing filaments by treating them with an aqueous alkali solution to cause the resultant treated filaments each to be provided with numerous concaves formed on the peripheral surface of each filament, each concave being composed of a hemisphere, hemispheroid or hemiellipsoid-shaped center portion and a pair of hemicone or hemielliptic cone-shaped wing portions thereof each extending from the center portion along the longitudinal axis of the individual filament in opposite direction to the other.

DETAILED DESCRIPTION OF THE INVENTION

Figure 1:
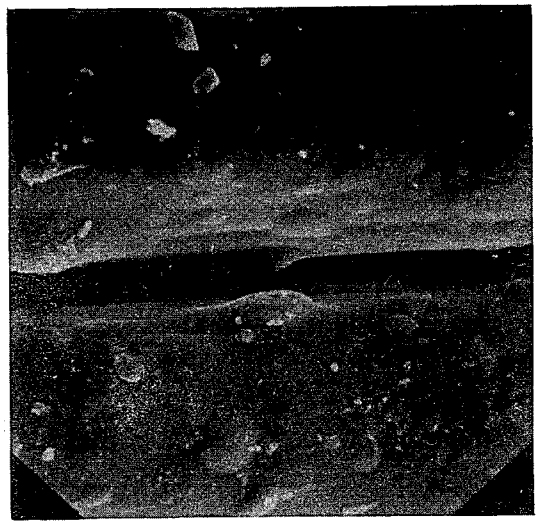
FIG. 1 is a scanning electron microscopic photograph (magnification: 3000) showing a peripheral surface of a filament of the present invention having numerous hemispheroidal or hemiellipsoidal protuberances.

The individual thermoplastic filament of the present invention comprises 85 to 99% by weight, preferably, 91 to 97% by weight, of a thermoplastic fiber-forming matrix polymer and 1 to 15% by weight, preferably, 3 to 9% by weight, of a dispersed polymer which is different from and incompatible with the matrix polymer. The dispersed polymer is dispersed in the form of numerous fine spheres, spheroids or ellipsoids, extending along the longitudinal axis of the individual filament, in the matrix polymer. In this type of filament, it is characteristic that a portion of the dispersed polymer located in the peripheral surface of the filament, forms numerous fine protuberances with at least 5 per 10 square microns, on the peripheral surface of the filament. The matrix polymer usable for the present invention is not limited to a special group of thermoplastic polymer, as long as the polymer is capable of being shaped into a filament or fiber and the resultant filament or fiber exhibits satisfactory mechanical properties, for example, elasticity rigidity, and elongation. The matrix polymer may be selected from the group consisting of fiber-forming polyesters, polyamides, polyolefins and polystyrene. The important matrix polymer for the present invention is polyester. The matrix polyester may be a polycondensation product of at least one dicarboxylic compound, for example, terephthalic acid or its reactive derivative, with at least one alkylene glycol component, for example, ethylene glycol, propylene glycol, butylene glycol. Preferably, the matrix polyester is polyethylene terephthalate, polybutylene terephthalate or a copolyester containing 75 molar % or more, more preferably, 85 molar % or more, of the recurring alkylene terephthalate units derived from the esterification reaction of an alkylene glycol with terephthalic acid or its functional derivative. Also, it is preferable that the matrix polyester has a limiting (intrinsic) viscosity of 0.4 or more measured in o-chlorophenol at a temperature of 35° C.

The matrix polymer may contain, as additives, a catalyst residue, ether-generation-preventing agent, stabilizer, flame retardant, anti-static agent, hydrophilicity-enhancing agent, coloring material, optical brightening agent, and/or delustering agent.

The dispersed polymer usable for the present invention is not limited to a special group of polymers, as long as the polymer is different from, non-reactive to and incompatible with the matrix polymer. It is preferable that the dispersed polymer is non-crystalline and has a glass transition temperature of at least 150° C. The glass transition temperature of the dispersed polymer can be determined by the method described in U.S. Pat. No. 2,556,295. The non-crystallinity of the dispersed polymer can be determined by the X-ray wide angle diffractometry. When no diffraction point or line is found in the diffraction X-ray photograph of the dispersed polymer, it is deemed that the dispersed polymer is non-crystalline.

The dispersed polymer may be selected from polysulfones having the recurring units of the formulae (I) through (IV):

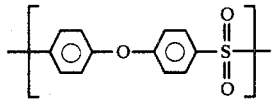
(I)

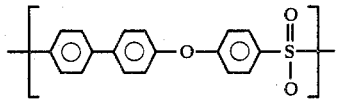
(II)

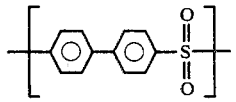
(III)

and

-continued

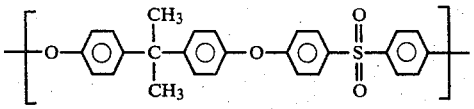

(IV)

The preferable polysulfone is one of the formula (IV) having a degree of polymerization of 60 to 120.

The dispersed polymer is used in an amount of from 1 to 15% by weight, preferably, from 3 to 9% by weight. When the amount of the dispersed polymer is less than 1% by weight, the number of the resultant protuberances is less than 5 per 10 square microns of the peripheral surface of the resultant filament, and, therefore, the surface appearance and the frictional property of the resultant filament are unsatisfactory. Also, more than 15% by weight of the dispersed polymer causes the resultant filament to exhibit a poor mechanical strength and, therefore, to be practically useless.

When a mixture of the matrix polymer and the dispersed polymer is melt-spun into filaments, at an elevated temperature higher than the melting point of the matrix polymer, the resultant filaments are provided with numerous fine protuberances formed on the peripheral surface of each individual filament. The density of the protuberances is at least 5 per 10 square microns of the peripheral surface of the individual filament. In this density, the protuberances are effective for delustering the surface of the resultant filament and for decreasing the dynamic friction of the filament peripheral surfaces with each other and with metal surfaces. Therefore, the filament can exhibit a satisfactory delustered surface appearance and a satisfactory frictional property and hand. The decreased dynamic frictional property of the filament is effective in increasing the draping property of the fabric made from the filament. Preferably, the protuberances are each in the form of a hemispheroid or hemiellipsoid extending along the longitudinal axis of the individual filament. Also it is preferable that the area of the bottoms of the protuberances is 0.5 square microns or more.

The filaments of the present invention may have a circular cross-sectional profile or an irregular cross-sectional profile, for example, trilobal or another multilobal cross-sectional profile. The irregular cross-sectional profile is effective for imparting a silk-like gloss and hand to the filament.

The dispersed polymer particles dispersed in the matrix polymer in the filaments are effective for enhancing the dyeing property of the filaments, because numerous small voids are formed in the interface between the matrix polymer phase and the dispersed polymer phase. Also, since there is a small difference in the thermal shrinkage between the matrix polymer phase and the dispersed polymer phase, the woven or knitted fabric made from the filaments of the present invention can have a preferable bulkiness and hand.

Figure 2:
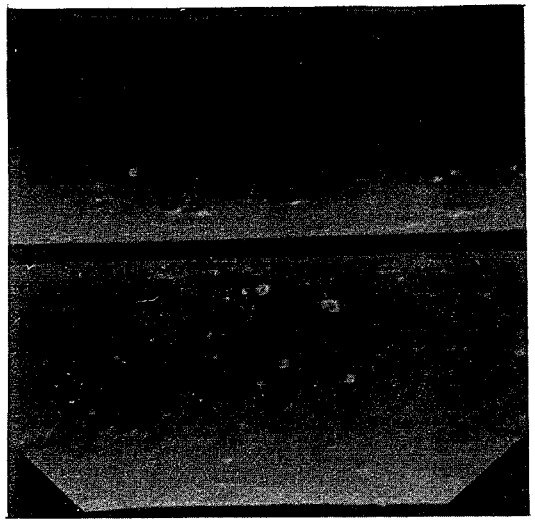
FIG. 2 is a scanning electron microscopic photograph (magnification: 3000) showing a peripheral surface of a conventional filament containing 1% by weight of titanium dioxide particles and having numerous projections.

FIG. 1 shows an electron microscopic view of a peripheral surface of the filaments of the present invention in a magnification of 3000. Also, FIG. 2 shows an electron microscopic view of a peripheral surface of a conventional filament containing 1% by weight of titanium dioxide. The peripheral surface of the filament as indicated in FIG. 2 is provided with extremely small projections having irregular shapes. The extremely small projections do not cause the resultant filament to exhibit the properly delustered surface appearance and a proper frictional property like those of the present invention.

In the preparation of the thermoplastic synthetic filaments of the present invention, a mixture of 85 to 99% by weight of a thermoplastic matrix polymer with 1 to 15% by weight of a dispersed polymer which is incompatible with the matrix polymer, is prepared. This mixture may be prepared in such a manner that the dispersed polymer is admixed to a polymerization mixture containing monomers for producing the matrix polymer and, then, the admixed polymerization mixture is subjected to a polymerization of the monomers. The resultant polymerization mixture contains the resultant matrix polymer and the dispersed polymer which is non-reactive with the matrix polymer. Otherwise, the mixture may be prepared by mixing the matrix polymer with the dispersed polymer.

The mixture is subjected to a spinning process which may be a melt spinning process, dry spinning process or wet spinning process. When the matrix polymer is a polyester, the mixture containing the polyester is subjected to a melt-spinning process.

When the filaments of the present invention are subjected to a draft zone system spinning process or a fabric made from the filaments is subjected to a raising process, it is preferable that the filaments exhibit a snap back value of 4% or less. The term "snap back value" used herein is defined by the equation (1):

$$SB=(eb-esb)-eb\times rb/100$$

wherein SB represents a snap back value in % of the filaments, eb represents a breaking elongation in % of the filaments, rb represents a tensile recovery in % of the filaments at its break and esb represents an elongation of the filaments determined from the difference between the length of the filament at its break and the original length of the filament. When the snap back value is more than 4%, the filaments sometimes exhibit a poor stretch-breaking property in the draft zone system spinning process and the fabric made from the filaments sometimes exhibit an unsatisfactory raising property in the raising process. That is, sometimes, the resultant spun yarn is uneven and the resultant raised fabric exhibits an uneven surface appearance.

Also, it is preferable that the filaments of the present invention exhibit a breaking modulus of 4 g/d or less. The term "breaking modulus" used herein is defined by the equation (2):

$$Mb=\frac{sb\times(100+eb)}{D_0} \quad (2)$$

wherein Mb represents a breaking modulus in g/d of a filament, sb represents a gradient in g/% of a tangential line drawn through a breaking point of the filament on the stress-strain curve of the filament, eb represents a breaking elongation in % of the filament and $D_0$ represents a denier of the filament.

The filaments having a breaking modulus of 4 g/d or less can exhibit a proper stretch-breaking property and raising property.

The filaments of the present invention, in which the matrix polymer is a polyester, may be treated with an alkali aqueous solution. The alkali treatment results in formation of numerous concaves on the peripheral surface of the individual filament. Each concave is composed of a center portion thereof, which is in the form of a hemisphere, hemispheroid or hemiellipsoid, and a pair of wing portions thereof each of which is in the form of a hemicone or hemielliptic cone and extends from the center portion in opposite direction to the other along the longitudinal axis of the individual filament. The bottom of each wing portion is connected to the center portion. The center portion of the concave is derived from the removal of the protuberance by the alkali treatment. Also, the wing portion of the concave is derived from the removal of a portion of the matrix polymer located just adjacent to the protuberance.

The alkali may be selected from the group consisting of sodium hydroxide, potassium hydroxide, tetramethylammonium hydroxide, sodium carbonate and potassium carbonate. The most preferable alkali is sodium hydroxide or potassium hydroxide.

The concentration of the alkali in its aqueous solution is variable depending on the type of alkali and treating conditions. However, it is preferable that the concentration of the alkali is usually in the range of from 0.1 to 40% by weight, more preferably, from 0.1 to 30% by weight. The alkali treatment is preferably carried out at a temperature of from room temperature to 100° C., for one minute to 4 hours. Also, it is preferable that the alkali treatment causes a reduction in the weight of the filaments to an extent of at least 10% of the original weight of the filaments. By this alkali treatment, the protuberances on the peripheral surface of the individual filament are removed so as to form the concaves in the form of hemispheroid or hemiellipsoid.

In the alkali-treated individual filament, it is preferable that each concave has an opening area of at least 5 square microns. Also, it is preferable that the number of the concaves is at least one per 300 square microns of the peripheral surface of the individual filament.

Figure 3:
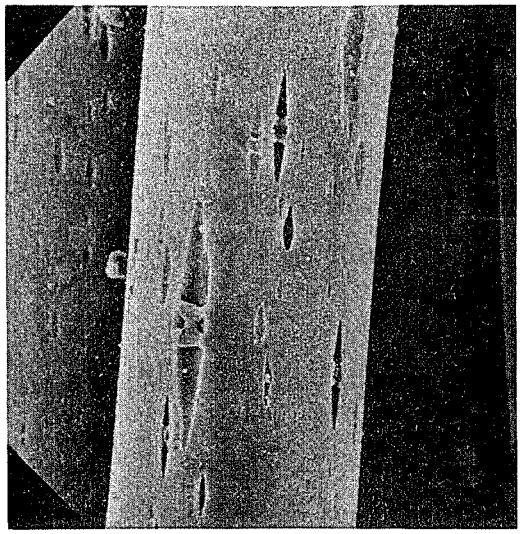
FIG. 3 is a scanning electron microscopic photograph (magnification: 3000) showing a peripheral surface of a filament modified from the filament of the present invention as shown in FIG. 1 and having numerous specific concaves.

FIG. 3 shows an electron microscopic view of a peripheral surface of an alkali-treated individual filament which has been prepared from the individual filament of the present invention as indicated in FIG. 1. Referring to FIG. 3, each concave formed on the peripheral surface of the filament is composed of a hemisphere, hemispheroid or hemiellipsoid-shaped, caved center portion and a pair of hemicone or hemielliptic cone-shaped, caved wing portions, extending from the center portion in opposite directions to each other along the longitudinal axis of the filament. This configuration of the concave is very specific and was obtained only by alkali treating the filament of the present invention.

Also, it is important that the alkali treatment applied to the filaments of the present invention does not cause the resistance of the resultant filament to fibrilization to be reduced. That is, the alkali treated filaments exhibit a satisfactory resistance to abrasion.

Figure 4:
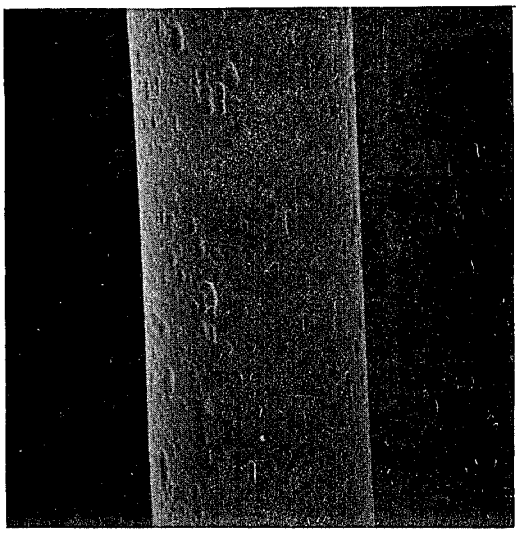
FIG. 4 is a scanning electron microscopic photograph (magnification: 3000) showing a peripheral surface of a comparative filament modified from the conventional filament as indicated in FIG. 2 and having irregularly shaped concaves.

When the conventional filament as shown in FIG. 2 is treated with the alkali aqueous solution, the treated filament is provided with numerous concaves as shown in FIG. 4. The concaves as shown in FIG. 4 are significantly smaller than and different in configuration from the specific concaves as shown in FIG. 3. That is, the configuration of the concaves shown in FIG. 4 is irregular.

The filaments of the present invention can be converted into a false-twisted filament yarn having an appearance and touch similar to those of conventional hard twist filament yarn. That is, the filaments, which are polyester filaments in a partially oriented state and in the form a filament yarn, are draw-false twisted under the conditions satisfying the relationship (3):

$$\alpha \leqq 0.02T - 1.5D - 1.05 \quad (3)$$

wherein $\alpha$ represents a twist multiplier to be applied to the filament yarn in the range of from 0.4 to 0.9, T represents a false twisting temperature to be applied to the filament yarn in the range of from 150° to 200° C. and D represents a draw ratio to be applied to the filament yarn satisfying the relationship (4):

$$0.80R_0 \leqq D \leqq R_0,$$

wherein $R_o$ represents a draw ratio which causes the resultant drawn filament yarn to exhibit an ultimate elongation of 30%.

The twist multiplier ($\alpha$) of the filament yarn can be calculated in accordance with the equation (5):

$$TN = \alpha \frac{32500}{\sqrt{De}} \quad (5)$$

wherein TN represents the number of twists applied to the filament yarn and De represents a denier of the resultant drawbm false-twisted filament yarn.

The filament yarn to be subjected to the above mentioned draw-false twisting procedure is a partially oriented filament yarn preferably having an ultimate elongation of from 70 to 200%. The partially oriented filament yarn can be produced by a conventional high speed spinning process. The spinning speed adquate to produce the partially oriented filament yarn is variable depending on the intrinsic viscosity of the matrix polymer, the type and concentration of the dispersed polymer and the denier of the resultant individual filament. Usually, the spinning process is performed at a high speed of 2000 to 5500 m/sec.

In the above-mentioned draw-false twisting procedure, the filament yarn may consist of the filaments of the present invention alone or a blend of the filaments of the present invention with another type of filament.

The draw-false twisting procedure is distinctive in the relatively low draw-false twisting temperature of from 150° to 200° C., from the conventional draw-false twisting procedure for conventional polyester filament yarn. In order to produce a drawn, false twisted polyester filament yarn having a hard twist yarn-like touch, it is necessary that the draw-false twisting temperature to be applied to the polyester filament yarn is 215° C. or more. However, such high temperature causes the individual filaments in the yarn to be fuse-bonded to each other and the dyeability of the filament yarn to be significantly changed. However, in the above-mentioned draw-false twisting procedure, the draw-false twisting temperature is relatively low. Therefore, the change in the dyeability of the filament yarn is very small and the filament yarn exhibits a satisfactory draping property. However, the individual filaments in the filament yarn are fuse-bonded to each other to a satisfactory extent.

The drawn, false-twisted filament yarn exhibits a satisfactory weaving and knitting property. In order to stabilize the filament yarn, it is preferable to relax the filament yarn at an elevated temperature, for example, 210° to 230° C., more preferably, while overfeeding the filament yarn at a degree of overfeed of 2 to 7% so that the resultant relaxed filament yarn exhibits a torque of 50 turns/m or less.

In the filament of the present invention, when the matrix polymer is a polyester, the dispersed polymer may contain at least one member selected from the group consisting of polytetrafluoroethylene, tetrafluoroethylene-hexafluoropropylene copolymers, polychlorotrifluoroethylene, polyvinylidene fluoride and polyvinyl fluoride which are inconpatible with the polyester and have a glass transition temperature of 150° C. or less, and, also which exhibit a melt viscosity of $10^5$ poises or more when these are heated to a temperature of or close to the melting point thereof.

SPECIFIC EXAMPLES OF THE INVENTION

The following specific examples are presented for the purpose of clarifying the present invention. However, it should be understood that these are intended only to be examples of the present invention and are not intended to limit the present invention in any way.

using a slit heater and, then, wound up at a speed of 800 m/min.

In Comparison Example 1, the resultant drawn individual filament had substantially no hemisphere or hemiellipsoid protuberance. This filament had only very small irregular shaped protuberances which were derived from the titanium dioxide particles. Also, in Comparison Example 2, the resultant drawn individual filaments exhibited extremely poor tensile strength and ultimate elongation and, therefore, were useless for practical use.

The resultant drawn individual filaments in Examples 1 through 5 each exhibited satisfactory coefficients of fiber-fiber dynamic friction and tensile strength and ultimate elongation, and had an adequately delustered appearance thereof.

TABLE 1

| | | | Item | | | | | | |
|---|---|---|---|---|---|---|---|---|---|
| | | | Protuberance | | | | | | |
| Example | | Amount of dispersed polymer (wt %) | Configuration | The number per 10 square microns | Bottom area (square micron) | Coefficient of fiber-fiber dynamic friction at a speed of 3600 cm/min | Denier/ the number of filaments | Tensile strength (g/d) | Ultimate elongation (%) |
| Comparative Example | 1 | 0.5 | Substantially no hemisphere or hemielliproid protuberance | | | 0.398 | 51/24 | 4.5 | 25.0 |
| | 1 | 1.5 | Hemisphere | 6.5 | 0.55 0.75 | 0.323 | 50/24 | 4.0 | 26.0 |
| | 2 | 3.0 | Hemisphere hemielliproid | 8.0 | 0.50 0.80 | 0.300 | 50/24 | 3.8 | 24.8 |
| Example | 3 | 6.0 | Hemisphere hemielliproid | 12.0 | 0.60 0.85 | 0.286 | 51/24 | 3.4 | 16.5 |
| | 4 | 9.0 | Hemisphere hemielliproid | 15.5 | 0.55 0.90 | 0.264 | 52/24 | 3.2 | 15.0 |
| | 5 | 12.0 | Hemisphere | 18.0 | 0.60 0.85 | 0.225 | 50/24 | 3.0 | 12.5 |
| Comparative Example | 2 | 16.0 | Hemisphere | 20.5 | 0.55 0.90 | 0.203 | 51/24 | 1.8 | 4.8 |

EXAMPLES 1 THROUGH 5 AND COMPARATIVE EXAMPLES 1 AND 2

In each of the Examples 1 through 5 and Comparative Examples 1 and 2, the amount as indicated in Table 1 of a dispersed polymer consisting of a polysulfone having a recurring unit of the formula:

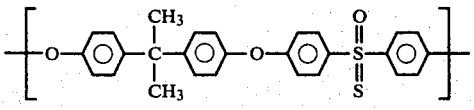

was mixed with the balance consisting of a matrix polymer, that is, a polyethylene terephthalate having an intrinsic viscosity of 0.64 determined in O-chlorophenol at a temperature of 35° C., and containing 0.03% by weight of titanium dioxide.

The mixture was dried and melted in an extruder at a temperature of 315° C. and, then, extruded through a spinneret having 24 spinning orifices each having a diameter of 0.3 mm, at a temperature of 290° C. The filamentary streams of the extruded mixture were introduced into a spinning chimney and cooled by blowing cooling air laterally through the chimney at a flowing linear speed of 0.2 m/sec to solidify them. After oiling, the solidified filaments were wound up at a winding speed of 1400 m/min.

The resultant undrawn filament yarn was preheated at 90° C. for 0.35 seconds by using a heating roll and drawn at a draw ratio of 3.0. Finally, the drawn filament yarn was bent treated at a temperature of 230° C. by

COMPARATIVE EXAMPLE 3

The same procedures as those described in Example 1 were carried out, except that no dispersed polymer was used and the matrix polymer contained 1.0% by weight of titanium dioxide.

The resultant drawn filament had a satisfactorily delustered appearance thereof close to that in Example 4 but not hemisphere, hemispheroid or hemiellipsoid protuberance.

EXAMPLE 6

The drawn filaments obtained in Example 3 were converted into a tricot fabric. This fabric exhibited a satisfactory high bulkiness and dyeability and a desirable dry touch.

EXAMPLES 7 THROUGH 11 AND COMPARATIVE EXAMPLES 4 AND 5

In each of the Examples 7 through 11 and Comparative Examples 4 and 5, the same procedures as those described in Example 1 were carried out with the following exception.

The used dispersed polymer consisted of a polysulfone compound which was produced and sold in the trademark of Udel by Union Carbide Co., U.S.A. and which was non-crystalline and incompatible with the polyethylene terephthalate used and had a glass transition temperature of 175° C.

The mixture of the matrix polymer and the dispersed polymer in the amount as indicated in Table 2 was dried at a temperature of 160° C. for 4 hours before the melt-extruding procedure.

The spinneret used had 36 spinning orifices each having a diameter of 0.4 mm, and the extruded filamentary streams of the melted mixture was cooled by blowing cooling air at a flow linear speed of 0.3 m/sec across a spinning chimney to solidify them.

The solidified filament was oiled and, then, wound up at a winding speed of 1200 m/min.

The resultant undrawn filaments were preheated at a temperature of 90° C. for 0.3 seconds, and drawn at a draw ratio of 3.3.

The properties of the resultant filaments are indicated in Table 2.

TABLE 2

| Example | | Amount of dispersed polymer (wt %) | Item: Protuberance: Configuration | Protuberance: The number pr $10\mu^2$ | Protuberance: Bottom area ($\mu^2$) | Coefficient of fiber-fiber dynamic friction at a speed of 3600 cm/min | Denier/ the number of filaments | Tensile strength (g/d) | Ultimate elongation (%) |
|---|---|---|---|---|---|---|---|---|---|
| Comparative Example | 4 | 0.5 | Substantially no hemisphere or hemielliproid protuberance | | | 0.398 | 52/36 | 4.6 | 28.0 |
| | 7 | 1.5 | Hemielliproid | — | — | 0.323 | 51/36 | 3.8 | 25.0 |
| | 8 | 3.0 | Hemisphere and hemielliproid | — | — | 0.300 | 50/36 | 3.6 | 23.5 |
| Example | 9 | 6.0 | Hemisphere and hemielliproid | — | — | 0.286 | 51/36 | 3.3 | 18.2 |
| | 10 | 9.0 | Hemisphere and hemielliproid | — | — | 0.264 | 51/36 | 3.0 | 14.6 |
| | 11 | 12.0 | Hemisphere | — | — | 0.225 | 50/36 | 2.8 | 12.9 |
| Comparative Example | 5 | 16.0 | Hemisphere | — | — | 0.203 | 52/36 | 1.6 | 6.0 |

In Comparative Example 4, the resultant drawn individual filament had very small irregular protuberances which were derived from the fine particles of titanium dioxide, but had substantially no hemisphere or hemiellipsoid protuberance. Also, the resultant individual filament in Comparative Example 5 exhibited extremely poor tensile strength and ultimate elongation and therefore, was useless for practical use.

EXAMPLES 12 THROUGH 16 AND COMPARATIVE EXAMPLES 6, 7 AND 8

In each of the Examples 12 through 16 and Comparative Examples 6, 7 and 8, the amount as indicated in Table 3 of the same dispered polymer as that described in Example 6 was mixed with the balance consisting of the same polyethylene terephthalate as that described in Example 1. The mixture was dried at 160° C. for 4 hours and meltextruded in the same manner as that described in Example 1, and the solidified filaments were oiled and, then, wound at a speed of 1500 m/min.

The resultant undrawn filament yarn was preheated at 90° C. for 0.3 seconds on a heating roll and drawn at a draw ratio of 2.8. The drawn filament yarn was bent-treated at 210° C. by using a slit heater and wound at a speed of 800 m/min. The results are shown in Table 3.

TABLE 3

| Example No. | | Amount of dispersed polymer (wt %) | Item: Drawn filament yarn: Denier (de/24 fil) | Tensile strength (g/de) | Ultimate elongation (%) | Breaking modulus (g/de) | Sanp back value (%) |
|---|---|---|---|---|---|---|---|
| Comparative Example | 6 | 0 | 75 | 5.2 | 29.5 | 6.6 | 7.0 |
| | 7 | 0.5 | 76 | 4.6 | 28.0 | 5.4 | 5.8 |
| | 12 | 1.5 | 75 | 3.8 | 25.0 | 4.1 | 3.9 |
| | 13 | 3.0 | 76 | 3.6 | 23.5 | 3.8 | 3.6 |
| | 14 | 6.0 | 78 | 3.3 | 18.2 | 3.4 | 3.1 |
| | 15 | 9.0 | 77 | 3.0 | 14.6 | 3.2 | 2.7 |
| | 16 | 12.0 | 74 | 2.8 | 12.9 | 3.1 | 2.2 |
| Comparative Example | 8 | 16.0 | 75 | 1.6 | 6.0 | 3.0 | 2.0 |

In each of Comparative Examples 6 and 7, the resultant filament yarn exhibited a large snap back value and breaking modulus and, therefore, is not suitable for the draft zone system spinning process and raising process. Also, the resultant filament yarn in Comparative Example 8 exhibited an extremely poor tensile strength and ultimate elongation and, therefore, is useless for practical use.

The filament yarns obtained in Examples 12 through 16 exhibited a satisfactory tensile strength, ultimate elongation, breaking modulus and snap back value. Therefore, these filament yarns are useful for the draft zone system spinning process and for producing a raised fabric.

EXAMPLES 17 THROUGH 21 AND COMPARISON EXAMPLES 9 THROUGH 11

In each of the Examples 17 through 21 and Comparative Examples 9 through 11, the same procedures as those described in Example 12 were carried out, except that the amount of the dispersed polymer was as indicated in Table 4, the spinning orifices each had a diameter of 0.27 mm, the extrusion of the melted mixture was carried out at a temperature of 295° C., the oiled undrawn filaments were wound at a speed of 1200 m/min and the heat treatment for the drawn filament yarn was carried out at a temperature of 220° C. The properties of the resultant filament yarn are indicated in Table 4.

TABLE 4

| Example No. | | Amount of dispersed polymer (wt %) | Item Drawn filament yarn: Configuration of protuberance | Denier per 24 filaments (d/24 fil) | Tensile strength (g/d) | Ultimate elongation (%) |
|---|---|---|---|---|---|---|
| Comparative Example | 9 | 0 | no protuberance | 76/24 | 5.1 | 31.2 |
| | 10 | 0.5 | substantially no hemisphere or hemielliproid protuberance | 75/24 | 4.7 | 29.1 |
| | 17 | 1.5 | Hemiellipsoid | 76/24 | 4.3 | 25.8 |
| Example | 18 | 3.0 | Hemisphere and hemiellipsoid | 73/24 | 3.6 | 23.1 |
| | 19 | 6.0 | Hemisphere and hemiellipsoid | 74/24 | 3.3 | 18.8 |
| | 20 | 9.0 | Hemisphere and hemiellipsoid | 75/24 | 3.0 | 16.1 |
| | 21 | 12.0 | Hemisphere | 74/24 | 2.7 | 14.3 |
| Comparative Example | 11 | 16.0 | Hemisphere | 76/24 | 1.8 | 6.2 |

Each filament yarn was converted into a knitted fabric. The fabric was scoured and dried in an ordinary manner. The dried fabric was treated with an aqueous solution of sodium hydroxide in concentration as shown in Table 5 at a boiling temperature of the solution for the time period as indicated in Table 5. The decrease in the weight of the filament yarn is indicated in Table 5. Also, the configuration, opening area and the numbers of concaves formed on the peripheral surface of the alkali-treated individual filament and the water-absorption and fibril-forming property of the alkali-treated filament yarn are shown in Table 5.

times with a crepe suzette fabric made of polyethylene terephthalate multifilament yarns having a yarn count of 75 denier/36 filaments, and having a weight of 90 g/m$^2$ under a load of 500 g by using a rubbing tester. After the rubbing procedure, the surface of the specimen was observed by the naked eye.

The opening area of the concaves were measured in the following manner. After the alkali treatment, the peripheral surface of the individual filament was photographed for an electron microscopic observation at a magnification of 3000. From the photograph, the opening area of the concave was measured.

TABLE 5

| Type of filament yarn used | | Item: Alkali treatment: Concentration of NaOH | Time (min) | Decrease in weight of filament yarn (wt %) | Alkali-treated filament: Configuration of concave | open area of concave ($\mu^2$) | The number of concaves per 300$\mu^2$ | Water-absorption (%) | Formation of fibril |
|---|---|---|---|---|---|---|---|---|---|
| Comparison Example | 9 | — | — | 15 | Linear | — | 0 | 22.3 | no |
| | 10 | — | — | 15 | " | — | 0 | 31.1 | " |
| Example 17 | | — | — | 15 | (*) | 5.2~6.3 | 1 | 42.2 | " |
| Example 18 | | — | — | 5 | Linear | — | 0 | 38.5 | " |
| Example 18 | | — | — | 15 | (*) | 5.9~7.8 | 2 | 45.6 | " |
| Example 18 | | — | — | 25 | " | 6.5~9.2 | 3 | 53.2 | " |
| Example 19 | | — | — | 15 | " | 6.4~9.4 | 4 | 46.2 | " |
| Example 19 | | — | — | 25 | " | 7.0~11.2 | 5 | 58.3 | " |
| Example 20 | | — | — | 15 | " | 6.8~10.2 | 5 | 61.5 | " |
| Example 21 | | — | — | 15 | " | 6.9~9.8 | 5 | 65.8 | " |
| Comparative Example | 11 | — | — | 15 | " | 7.2~10.8 | 6 | 64.2 | yes |

Note:
(*) The concave was composed for a hemisphere, hemispheroid or hemiellipsoid-shaped center portion thereof and a pair of hemicone or hemielliptic cone-shaped wing portions thereof.

The water absorption was determined as follows. A test specimen was completely dried and the weight ($W_o$) of the dried specimen was measured. The specimen was immensed in water at room temperature for 30 minutes and, then, centrifuged for 5 minutes by using a home centrifuge. The weight ($W_1$) of the centrifugalized specimen was measured. The water absorption (WA) of the specimen was calculated from the following equation.

$$WA\ (\%) = \frac{W_l - W_o}{W_o} \times 100$$

The fibril-forming property was observed in the following manner. A test specimen (fabric) was rubbed 500

EXAMPLES 22 THROUGH 26 AND COMPARATIVE EXAMPLES 12 THROUGH 14

In each of the Examples 22 through 26 and Comparison Examples 12 through 14, the same procedures as those in Example 12 were carried out, except that the amount of the dispersed polymer was as indicated in Table 6, the number of the spinning orifices was 48, the linear flow speed of the cooling air was 0.3 m/sec, the winding speed for the solidified filaments was 1200 m/min, the draw ratio was 3.3 and the heat-treatment temperature for the drawn filament yarn was 230° C.

The properties of the resultant filament yarn are indicated in Table 6.

TABLE 6

| Example No. | | Amount of dispersed polymer (wt %) | Configuration of protuberance | Item: Drawn filament yarn: Denier per 48 filaments | Tensile strength (g/de) | Ultimate elongation (%) |
|---|---|---|---|---|---|---|
| Comparative Example | 12 | 0 | none | 151/48 | 5.0 | 29.6 |
| | 13 | 0.5 | Irregular | 150/48 | 4.8 | 28.0 |
| | 22 | 1.5 | Hemiellipsoid | 149/48 | 4.2 | 25.0 |
| | 23 | 3.0 | Hemisphere and hemiellipsoid | 152/48 | 3.6 | 24.2 |
| Example | 24 | 6.0 | Hemisphere and hemiellipsoid | 151/48 | 3.3 | 18.1 |
| | 25 | 9.0 | Hemisphere and hemiellipsoid | 150/48 | 3.0 | 15.2 |
| | 26 | 12.0 | Hemisphere | 150/48 | 2.8 | 13.1 |
| Comparative Example | 14 | 16.0 | Hemisphere | 151/48 | 1.7 | 5.8 |

The same alkali treatment as mentioned in Example 17 was applied to each filament yarn which was converted into a knitted fabric, except that the concentration of sodium hydroxide in the aqueous solution was 3.0%. The results are indicated in Table 7.

TABLE 7

| Type of filament yarn | | Item: Alkali treatment: Time (min) | Decrease in weight (%) | Alkali-treated filament yarn: Water-absorption (%) | The number and configuration of concaves | Formation of fibrils |
|---|---|---|---|---|---|---|
| Comparison Example | 12 | — | 15 | 24.1 | a few, linear | no |
| | 13 | — | 15 | 33.4 | many, linear | no |
| Example 22 | | — | 15 | 40.9 | a few, (*) | no |
| Example 23 | | — | 5 | 39.8 | a few, linear | no |
| Example 23 | | — | 15 | 44.6 | many, (*) | no |
| Example 23 | | — | 25 | 51.2 | many, (*) | no |
| Example 24 | | — | 15 | 47.9 | many, (*) | no |
| Example 24 | | — | 25 | 57.7 | many, (*) | no |
| Example 25 | | — | 15 | 60.6 | very many, (*) | no |
| Example 26 | | — | 15 | 61.8 | very many, (*) | no |
| Comparative Example | 14 | — | 15 | 58.9 | very many, (*) | no |

Note
(*) The same as that described under Table 5.

From Tables 5 and 6, it is clear that when the filament yarn of the present invention (Examples 17 through 26) was alkali treated to an extent that the decrease in weight was 10% or more, the resultant concaves had a specific shape and exhibited an excellent water absorption of 40% or more and a satisfactory resistance to the formation of fibrils.

EXAMPLES 27 THROUGH 44 AND COMPARATIVE EXAMPLES 15 THROUGH 18

In each of the Examples 27 through 44 and Comparative Examples 15 through 18, the same procedures as those described in Example 22 were carried out, except that the amount of dispersed polymer was as indicated in Table 8, the number of the spinning orifices was 36, the oiled filaments were wound at a high speed as indicated in Table 8, and the undrawn filament yarn had an ultimate elongation of about 120% and a denier of 150/36 filaments. That is, the resultant filaments were partially oriented filaments.

Each resultant filament yarn was draw-false twisted under the conditions as indicated in Table 8 by using a Draw-False twister (Type FW-III, made by Teijin Seiki K.K. Japan; the length of heater = 1.0 m), and the drawn, false twisted filament yarn was relaxed at a temperature of 200° C. while overfeeding the yarn at an overfeed of 5% by using a non-contact type heater, and wound at a speed of 100 m/min. The results are indicated in Table 8.

TABLE 8

| | | Amount of dispersed polymer (wt %) | Winding speed (m/min) | Item: Draw-false twisting process: Twist multiplier (α) | Draw ratio (D)*1 | Temperature (T) (°C.) | Drawn, false-twisted filament yarn: Hard twist yarn-like touch (class*4) | Degree of fuse-bonding (class*3) | Torque (T/m) |
|---|---|---|---|---|---|---|---|---|---|
| Comparative Example | 15 | 0 | 3300 | 0.65 | 1.3 | 235*2 | ordinary | ordinary | 43 |
| | 16 | 0 | 3300 | 0.40 | 1.2 | 200*2 | poor | poor | 30 |
| | 17 | 0.5 | 3300 | 0.40 | 1.2 | 200[2] | poor | poor | 35 |
| Example | 27 | 1.5 | 3000 | 0.45 | 1.3 | 195 | ordinary | ordianry | 20 |
| | 28 | 3.0 | 2800 | 0.50 | 1.4 | 190 | ordinary | ordinary | 35 |
| | 29 | 4.5 | 2600 | 0.75 | 1.5 | 200 | poor | poor | 45 |
| | 30 | 4.5 | 2600 | 0.75 | 1.4 | 195 | ordinary | ordinary | 40 |
| | 31 | 4.5 | 2600 | 0.75 | 1.3 | 190 | ordinary | ordinary | 35 |
| | 32 | 4.5 | 2600 | 0.60 | 1.3 | 190 | excellent | excellent | 30 |
| | 33 | 4.5 | 2600 | 0.50 | 1.3 | 190 | excellent | excellent | 20 |
| | 34 | 4.5 | 2600 | 0.50 | 1.3 | 180 | ordinary | ordinary | 25 |
| | 35 | 4.5 | 2600 | 0.50 | 1.3 | 170 | poor | poor | 30 |
| | 36 | 4.5 | 2600 | 0.50 | 1.2 | 170 | ordinary | ordinary | 25 |
| | 37 | 4.5 | 2600 | 0.40 | 1.2 | 170 | ordinary | excellent | 18 |
| | 38 | 6.0 | 2500 | 0.80 | 1.4 | 195 | poor | poor | 42 |
| | 39 | 6.0 | 2500 | 0.75 | 1.4 | 195 | ordinary | excellent | 38 |
| | 40 | 6.0 | 2500 | 0.6 | 1.4 | 190 | ordinary | excellent | 33 |
| | 41 | 6.0 | 2500 | 0.5 | 1.3 | 180 | excellent | excellent | 26 |
| | 42 | 6.0 | 2500 | 0.4 | 1.2 | 170 | excellent | excellent | 19 |
| | 43 | 9.0 | 2300 | 0.6 | 1.4 | 180 | excellent | excellent | 37 |
| | 44 | 12.0 | 2100 | 0.6 | 1.4 | 180 | excellent | excellent | 35 |
| Comparative Example | 18 | 16.0 | 2000 | 0.6 | 1.4 | 180 | Extremely poor strength | | |

Note:
*1R = 1.5
*2Relaxing temperature = 25° C.
*3Degree of fuse-bonding was determined by observing the cross-sectional profile of the drawn, false twisted filament yarn by using a microscope.

In Comparative Examples 16 and 17 in which the dispersed polymer was used in an amount less than 1%, the draw-false twisting procedure applied to the resultant filament yarns having substantially no protuberances failed to obtain hard twist filament yarn-like false twisted yarns, even when a high draw-false twisting temperature of 200° C. was applied to the filament yarns. In the Comparative Example 15 in which no dispersed polymer was used and the resultant filaments had no protuberance, an excessively high draw-false twisting temperature of 235° C. was applied to the filament yarn in order to cause the resultant yarn to exhibit a hard twist filament yarn-like configuration and touch.

In Comparative Example 18, the resultant filament yarn containing 16.0% of the dispersed polymer exhibited an extremely poor mechanical strength.

In Examples 27, 28, 30 through 34, 36, 37 and 39 through 44 wherein the draw-false twisting procedures were carried out under the conditions satisfying the relationship (3), the resultant filament yarns all exhibited satisfactory hard twist filament yarn-like configuration and touch. However, in Examples 29, 35 and 38 wherein the draw-false twisting procedures were carried out under conditions not satisfying the relationship (3), the resultant filament yarns exhibited unsatisfactory touch and degree of fuse fonding of the individual filaments.

Table 8 shows that as long as the relationship (3) is satisfied, the larger the amount of the dispersed polymer and the lower the twist multiplier and the draw ratio and the higher the draw-false twisting temperature, the better the hard twisted filament yarn-like configuration and touch.

EXAMPLES 45 THROUGH 62 AND COMPARATIVE EXAMPLES 19 THROUGH 22

In each of the Examples 45 through 62 and Comparative Examples 19 through 22, the same procedures as those described in Example 27 were carried out, except that the dispersed polymer was used in the amount as indicated in Table 9, the winding speed for the solidified filaments were as indicated in Table 9, and the draw-false twisting procedure was carried out under the conditions as indicated in Table 9. The results are indicated in Table 9.

TABLE 9

| Example No. | | Amount of dispersed polymer (wt%) | Winding speed (m/min) | Item: Draw-false twisting process: Twist multiplier (α) | Draw ratio (D)*1 | Temperature (T) (°C.) | Drawn, false twisted filament yarn: Hard twist yarn-like touch | Draping property | Torque (T/m) |
|---|---|---|---|---|---|---|---|---|---|
| Comparative Example | 19 | 0 | 3300 | 0.65 | 1.30 | 235*2 | remarkable | poor | 43 |
| | 20 | 0 | 3300 | 0.40 | 1.20 | 160*2 | poor | excellent | 53 |
| | 21 | 0.5 | 3300 | 0.40 | 1.20 | 160*2 | poor | excellent | 60 |
| Example | 45 | 1.5 | 3000 | 0.45 | 1.30 | 170 | ordinary | remarkable | 38 |
| | 46 | 3.0 | 2800 | 0.50 | 1.40 | 180 | ordinary | remarkable | 46 |
| | 47 | 3.0 | 2800 | 0.75 | 1.50 | 200 | ordinary | ordinary | 45 |
| | 48 | 3.0 | 2800 | 0.75 | 1.40 | 190 | ordinary | ordinary | 47 |
| | 49 | 3.0 | 2800 | 0.75 | 1.30 | 180 | ordinary | ordinary | 43 |
| | 50 | 3.0 | 2800 | 0.60 | 1.30 | 185 | excellent | very poor | 37 |
| | 51 | 3.0 | 2800 | 0.50 | 1.30 | 175 | ordinary | ordinary | 44 |
| | 52 | 3.0 | 2800 | 0.50 | 1.30 | 165 | ordinary | ordinary | 41 |

TABLE 9-continued

| Example No. | | Amount of dispersed polymer (wt%) | Winding speed (m/min) | Item: Draw-false twisting process: Twist multiplier (α) | Draw ratio (D)*1 | Temperature (T) (°C.) | Drawn, false twisted filament yarn: Hard twist yarn-like touch | Draping property | Torque (T/m) |
|---|---|---|---|---|---|---|---|---|---|
| | 53 | 3.0 | 2800 | 0.50 | 1.30 | 160 | ordinary | ordinary | 48 |
| | 54 | 3.0 | 2800 | 0.50 | 1.20 | 170 | ordinary | very poor | 43 |
| | 55 | 3.0 | 2800 | 0.40 | 1.20 | 160 | ordinary | ordinary | 38 |
| | 56 | 6.0 | 2500 | 0.80 | 1.40 | 195 | ordinary | ordinary | 42 |
| | 57 | 6.0 | 2500 | 0.75 | 1.40 | 180 | ordinary | ordinary | 43 |
| | 58 | 6.0 | 2500 | 0.60 | 1.40 | 180 | ordinary | ordinary | 38 |
| | 59 | 6.0 | 2500 | 0.50 | 1.30 | 180 | excellent | very poor | 26 |
| | 60 | 6.0 | 2500 | 0.40 | 1.20 | 160 | ordinary | ordinary | 30 |
| | 61 | 9.0 | 2300 | 0.60 | 1.40 | 170 | ordinary | ordinary | 43 |
| | 62 | 12.0 | 2100 | 0.60 | 1.40 | 170 | ordinary | ordinary | 41 |
| Comparative Example | 22 | 16.0 | 2000 | 0.60 | 1.40 | 170 | extremely poor strength | | |

Note:
*1$h_o$ = 1.5
*2Relaxing temperature = 235° C.

In Comparative Example 19 wherein the filaments contained no dispersed polymer, the draw-false twisting procedure was carried out at an excessively high temperature of 235° C. The resultant filament yarn exhibited poor draping property.

In Comparative Example 20 and 21 wherein the filaments contained zero or 0.5% by weight of the dispersed polymer, the draw-false twisting procedures were carried out at a relatively low twist multiplier of 0.40, draw ratio of 1.2 and temperature of 160° C. The resultant filament yarns exhibited an unsatisfactory hard twist filament yarn like configuration and touch.

In Comparative Example 22 wherein the dispersed polymer was used in a large amount, 16% by weight, the resultant filament yarn could not be draw-false twisted because of its extremely poor mechanical strength.

In Examples 45 through 49, 51 through 53, 55 through 58 and 60 through 62, wherein the draw-false twisting conditions satisfied the relationship (3), the resultant filament yarns exhibited satisfactory hard twist filament yarn-like configuration and touch and draping property. However, in Examples 50, 54, and 59, wherein the draw-false twisting conditions did not satisfy the relationship (3), the resultant filament yarns exhibited a poor draping property.

We claim:

1. Thermoplastic synthetic filaments comprising 85 to 99% by weight of a thermoplastic matrix polymer and 1 to 15% by weight of a dispersed polymer comprising at least one polysulfone which is incompatible with said matrix polymer and dispersed in the form of fine particles in said matrix polymer, which filaments are characterized by numerous fine protuberances consisting of said dispersed polymer and formed in the number of at least 5 per 10 square microns on the peripheral surface of each individual filament.

2. The filaments as claimed in claim 1, wherein said protuberances are each in the form of a hemisphere, hemispheroid or hemiellipsoid extending along the longitudinal axis of the individual filament.

3. The filaments as claimed in claim 1, wherein the area of bottoms of said protuberances is 0.5 square microns or more.

4. The filaments as claimed in claim 1, wherein said matrix polymer is thermoplastic polyester.

5. The filaments as claimed in claim 1, wherein said polyester consists essentially of recurring ethylene terephthalate units.

6. The filaments as claimed in claim 1, wherein said dispersed polymer is non-crystalline and has a glass transition temperature of at least 150° C.

7. The filaments as claimed in claim 1, wherein the amount of said dispersed polymer is in the range of from 3 to 9% by weight.

8. The filaments as claimed in claim 1, wherein the individual filaments exhibit a snap back value of 4% or less, said snap back value being defined by the equation (1):

$$SB=(eb-esb)-eb\times rb/100 \quad (1)$$

wherein SB represents a snap back value in % of the filaments, eb represents a breaking elongation in % of the filaments, rb represents a tensile recovery in % of the filaments at its break and esb represents an elongation in % of the filament determined from the difference between the length of the filament at its break and the original length of the filament.

9. A fiber as claimed in claim 1, wherein the individual fiber exhibits a breaking modulus of 4 g/d or less, said breaking modulus being defined by the equation (2):

$$Mb = \frac{sb \times (100 + eb)}{D_o} \quad (2)$$

wherein Mb represents a breaking modulus in g/d of the filament, sb represents a gradient in g/% of a tangential line drawn through a breaking point of the filament on the stress-strain curve of the filament, eb represents a breaking elongation in % of the filament and $D_o$ represents a denier of the filament.

10. The filaments as claimed in claim 1,2,3,4,5,6,7,8 or 9, wherein said polysulfone comprises the recurring unit of the formula

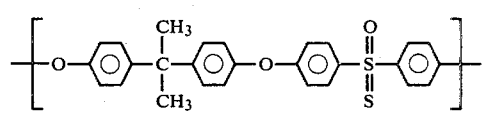

11. The filament as claimed in claim 1, wherein said protuberances are removed to cause formation of neumerous concaves on the peripheral surface of the individual filament, each concave being composed of a center portion thereof in the form of a hemisphere, hemispheroid or hemiellipsoid and a pair of wing portions thereof each in the form of a hemicone or hemielliptic cone and each extending from the ceter portion in opposit direction to the other along the longitudinal axis of the individual filament.

12. The filaments as claimed in claim 1, wherein said concaves each have an opening area of at least 5 square microns.

13. The filaments as claimed in claim 1, wherein the number of said concaves is at least one per 300 square microns of the peripheral surface of the individual filament.

* * * * *